US010189693B2

(12) United States Patent
Bruch et al.

(10) Patent No.: US 10,189,693 B2
(45) Date of Patent: Jan. 29, 2019

(54) FILLING ELEMENT AND FILING MACHINE

(71) Applicant: KHS GmbH, Dortmund (DE)

(72) Inventors: Bernd Bruch, Weinsheim (DE); Andreas Fahldieck, Idar-Oberstein (DE)

(73) Assignee: KHS GmbH, Dortmund (DE)

( * ) Notice: Subject to any disclaimer, the term of this patent is extended or adjusted under 35 U.S.C. 154(b) by 108 days.

(21) Appl. No.: 14/902,646

(22) PCT Filed: Jun. 30, 2014

(86) PCT No.: PCT/EP2014/063798

§ 371 (c)(1),
(2) Date: Jan. 4, 2016

(87) PCT Pub. No.: WO2015/000826

PCT Pub. Date: Jan. 8, 2015

(65) Prior Publication Data

US 2016/0167938 A1 Jun. 16, 2016

(30) Foreign Application Priority Data

Jul. 2, 2013 (DE) ..... 10 2013 106 927

(51) Int. Cl.

| | |
|---|---|
| ***B67C 3/28*** | (2006.01) |
| ***B67C 3/00*** | (2006.01) |
| ***B67C 3/22*** | (2006.01) |

(52) U.S. Cl.

CPC ..... *B67C 3/28* (2013.01); *B67C 3/004* (2013.01); *B67C 3/225* (2013.01); *B67C 3/281* (2013.01); *B67C 2003/228* (2013.01)

(58) Field of Classification Search

CPC ..... B67C 3/28; B67C 3/004; B67C 3/225; B67C 3/281; B67C 2003/228

USPC ..... 141/98

See application file for complete search history.

(56) References Cited

U.S. PATENT DOCUMENTS

| | | | | | |
|---|---|---|---|---|---|
| 4,787,427 | A * | 11/1988 | Bacroix | B67C 3/08 | 141/198 |
| 4,917,348 | A | 4/1990 | Phallen et al. | | |
| 5,099,895 | A * | 3/1992 | Loeliger | B65B 55/022 | 141/63 |
| 6,817,386 | B2 * | 11/2004 | Tsukano | B67C 3/281 | 141/146 |
| 2011/0039044 | A1 * | 2/2011 | Clusserath | B67C 3/001 | 428/34.1 |
| 2012/0180429 | A1 * | 7/2012 | Niehr | B67C 3/22 | 53/167 |

FOREIGN PATENT DOCUMENTS

| | | | | |
|---|---|---|---|---|
| EP | 0 268 524 | | 5/1988 | |
| FR | 2 592 869 | | 7/1987 | |
| FR | 2 739 431 | | 4/1997 | |
| GB | 860987 | * | 2/1961 | B67C 3/28 |
| GB | 2 237 011 | | 4/1991 | |

* cited by examiner

*Primary Examiner* — Timothy L Maust
(74) *Attorney, Agent, or Firm* — Occhiuti & Rohlicek LLP

(57) ABSTRACT

A filling element for filling containers includes a liquid valve disposed to control flow into the container. The valve has an elastic diaphragm and a valve surface. An actuator causes the diaphragm to transition between a first state, in which it butts against the valve surface, and a second state, in which it is spaced apart from the valve surface.

13 Claims, 9 Drawing Sheets

FILLING ELEMENT AND FILING MACHINE

RELATED APPLICATIONS

This application is the national stage under 35 USC 371 of international application PCT/EP2014/063798, filed on Jun. 30, 2014, which claims the benefit of the Jul. 2, 2013 priority date of German application DE 102013106927.4.

FIELD OF INVENTION

The invention relates to a filling element and to a filling system or a filling machine.

BACKGROUND

Filling elements are often used in filling machines to fill containers with liquid filling-material. These filling elements have a valve that controls dispensing of filing-material.

In known valves, a valve body arranged in the liquid channel of the filling element forms controls the dispensing of the filling contents to the containers. An actuating device moves the valve body, thus opening and closing the valve. A typical actuating device includes a valve tappet.

In its closed state, the valve body butts against a valve seat formed in the liquid channel. In the open state, the valve body is spaced apart from the valve seat, thus creating a gap that filling contents can flow through.

SUMMARY

An object of the invention is to provide a simpler valve for use in filling elements.

A special feature of the filling element according to the invention is the elimination of a conventional valve body. Instead, the valve element that undergoes controlled movement for the opening and closing of the valve is not a valve body, but a closure diaphragm.

In some embodiments, the closure diaphragm is made of an elastic material, such as an elastic plastic, e.g. from PTFE. Preferably, the diaphragm is a hollow body or funnel open at both ends. The funnel that forms the diaphragm has a cross-section that narrows in the direction of flow. The diaphragm is arranged at the filling element housing in such a way that, with the valve open, it forms the continuation of a liquid channel formed in a filling element housing.

In one aspect, the invention features an apparatus for filling containers with liquid filling material. Such an apparatus includes a filling element having a filling-element housing comprising a dispensing opening through which filling material flows into a container and a liquid channel formed in the housing through which filling material flows towards the dispensing opening, and a liquid valve disposed to control flow through the liquid channel into the container through the dispensing opening. The liquid valve has a diaphragm made of elastic material, and a valve surface. An actuator causes the diaphragm to transition between first and second states. In the first state, the diaphragm butts against the valve surface. And in the second state, the diaphragm is spaced apart from the valve surface.

Embodiments include those in which the elastic material is an elastomeric plastic, and those in which the elastic material comprises PTFE.

In some embodiments, the diaphragm is a hollow structure that is rotationally symmetric in relation to a diaphragm axis thereof. In these embodiments, the liquid valve also has a body having a surface that forms the valve surface. As a result of pressure from the actuator, the diaphragm abuts against the valve surface when the valve is closed. Among these embodiments are those in which, when the liquid valve opens, the diaphragm forms a continuation of the liquid channel, wherein the diaphragm comprises a funnel-shaped first section that narrows in the direction of the dispensing opening. In some of these embodiments, the diaphragm is arranged with an axis thereof coaxial with an axis of the filling element. Also among these embodiments are those in which the diaphragm comprises axially offset first and second sections, with the first section having a cross-section that decreases in area towards the container, and the second section having a constant cross-section. In some of these embodiments, the cross-section is circular and the diameter decreases monotonically as one proceeds towards the container along a first section of the diaphragm and then remains constant along a second section thereof.

In some embodiments, the valve surface is on a body that extends into a funnel-shaped section of the diaphragm. Among these are embodiments in which the body is a rod-shaped body having a tapered end that forms the valve surface.

In other embodiments, the diaphragm comprises first opening and second opening. The first opening has a larger cross-section than the second opening, and the second opening forms the dispensing opening.

Also among the embodiments are those in which the actuator connects to the diaphragm, those in which the diaphragm comprises an end region at the dispensing opening that connects to the actuator, and those in which the diaphragm is a funnel-shaped diaphragm having a section that forms a jet director.

Yet other embodiments include a gas block provided at the dispensing opening.

In some embodiments, the actuator comprises a hollow piston having a cylindrical body section and a base section having an opening. The cylindrical body section is axially displaceable along a filling element axis of the filling element. The base section engages the diaphragm.

In other embodiments, the actuator is displaced radially in relation to a filling element axis of the filling element, wherein the actuator is coupled for actuation of the diaphragm.

In yet other embodiments, the filling element is configured for free jet filling of containers.

Additional embodiments include a filling machine having a rotor that is drivable to rotate about a vertical machine axis. In these embodiments, the filling element is one of a plurality of identical filling elements disposed on the rotor. Each filling element, together with a corresponding container carrier forms a filling position. Among these are also embodiments having a tank containing the filling-material, a plurality of flow meters, of which magnetic inductive flow meters are but one example, and a plurality of product lines, each of which connects a filling element to the tank. Each of the product lines has an axis parallel to a filling element axis, and each of the product lines includes one of the flow meters.

In others of these embodiments, a sterile chamber lies under the rotor. The filling elements are arranged outside the sterile chamber and above the rotor. The sterile chamber has openings through which dispensing openings of the filling elements provide filling-material. Each of the filling elements has a seal that seals a portion of an opening through which the filling element provides filling-material. The portion of the opening through which the filling element provides filling-material is that portion that is not occupied by diaphragm of the filling element.

As used herein, the term "containers" refers to cans, bottles, tubes, and pouches, whether made of metal, glass, and/or plastic, as well as other packing means, in particular those that are suitable for the filling of liquid products.

As used herein, "free jet filling" refers to an arrangement in which liquid contents flow into a container in a free filling jet with the container being spaced with its container mouth or opening apart from the filling element or from a filling outlet or a content-dispensing opening located at the filling element.

As used herein, expressions such as "essentially," and "approximately" refer to deviations from an exact value by ±10%, preferably by ±5%, and/or deviations in shape or form that are insignificant to function.

Further embodiments, advantages, and application possibilities of the invention can also be derived from the following description of exemplary embodiments and from the figures. In this situation, all the features described and/or graphically represented are independently or in any desired combination in principle the object of the invention, regardless of their form of summary in the claims or references made to them. The contents of the claims also constitute a constituent part of the description.

BRIEF DESCRIPTION OF THE DRAWINGS

These and other features and advantages of the invention will be apparent from the following detailed description and the accompanying figures, in which.

DETAILED DESCRIPTION

FIGS. 1-4 show a filling element 1 that is a constituent part of a filling machine for free jet filling of containers 2. The filling element 1 is one of many similar filling elements disposed around a circumference of the filling machine's rotor 3. This rotor 3 rotates about the filling machine's vertical machine axis MA.

Figure 1:
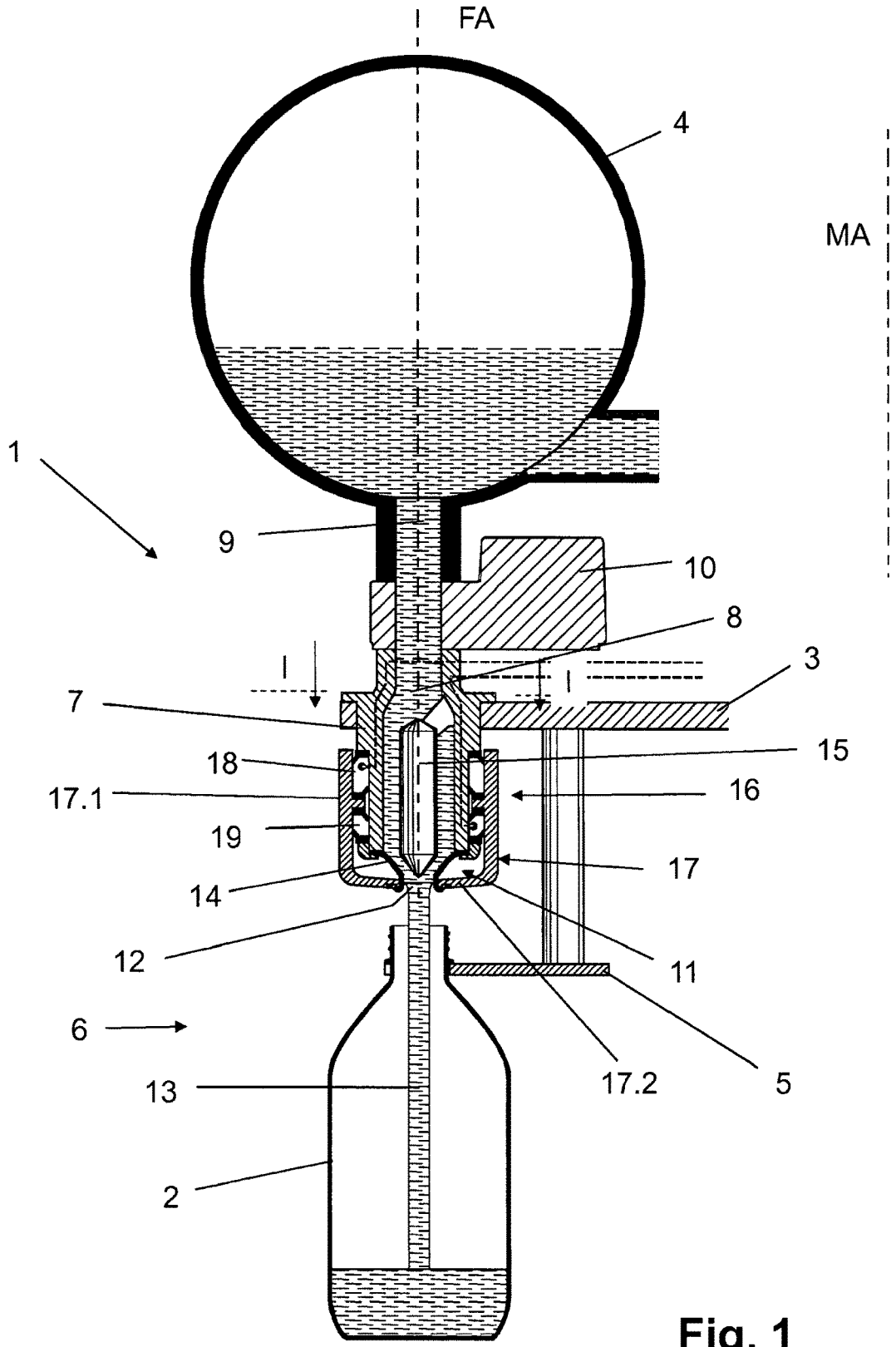
FIG. 1 shows a sectional view of a filling element for free jet filling of containers.
Figure 2:
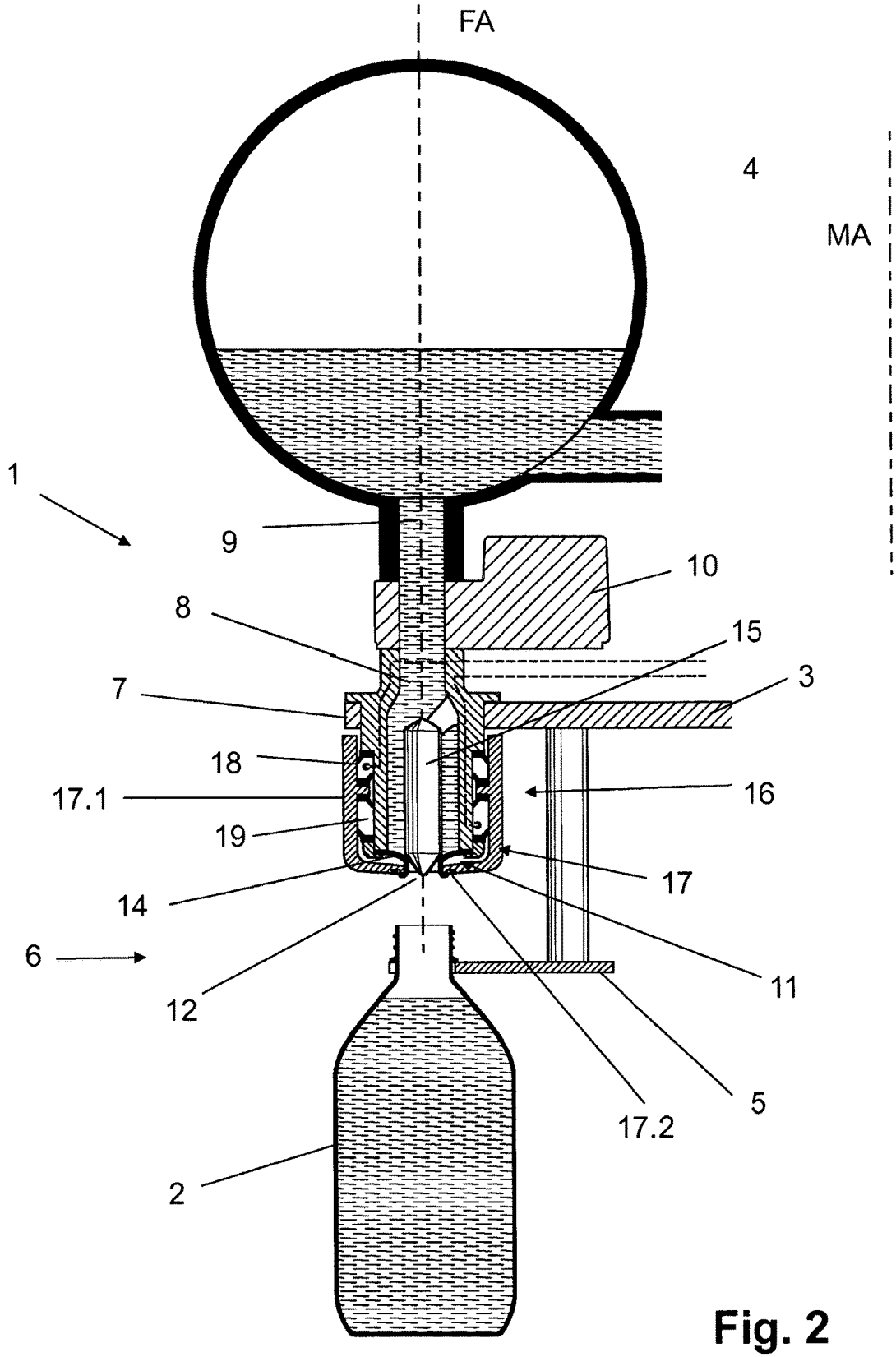
FIG. 2 shows the filling element of FIG. 1 with its valve closed instead of opened.

Disposed on the rotor 3 is a ring tank 4, a cross-section of which is shown in FIG. 1. The ring tank 4 is an annular tank that supplies filling material to all the filling elements 1. During the filling process, the ring tank 4 is at least partially filled with the liquid contents.

Each filling element 1 has an associated container carrier 5 that suspends a container 2 by a neck flange located below its opening. The filling element 1 and its associated container carrier 5 define a filling position 6.

The filling element 1 includes a liquid channel 8 formed in a housing 7. A product channel 9 extending along a filling element axis FA connects an upper end of the liquid channel 8 to the tank 4. Along the product channel 9 is a flow meter 10. In some embodiments, the flow meter 10 is a magnetic-inductive flow meter.

Figure 3:
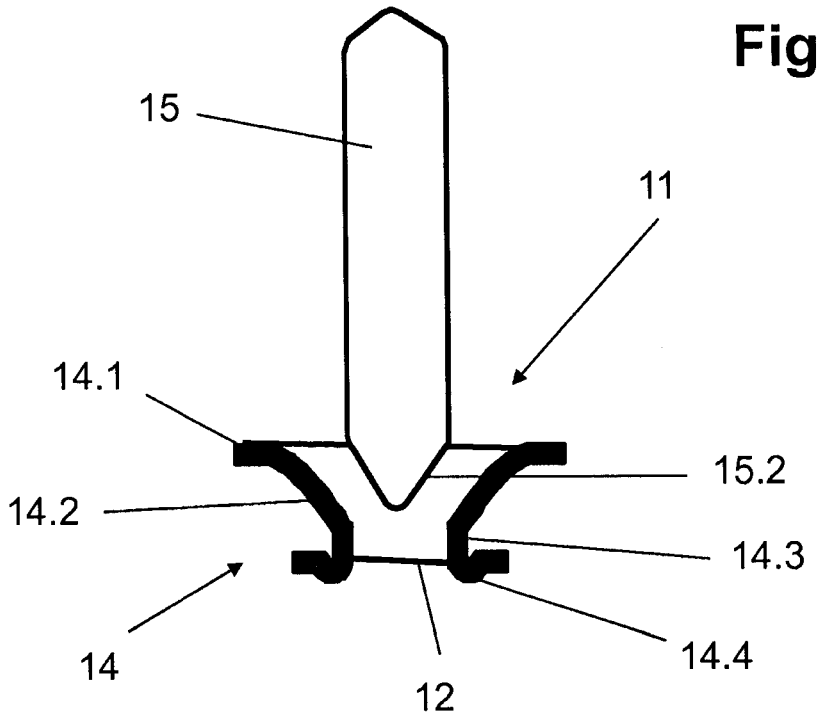
FIG. 3 shows a closure diaphragm together with a valve body forming a valve seat.

Provided on the underside of the filling element housing 7 is a valve 11, the structure of which is shown in detail in FIG. 3. In its open state, shown in FIG. 1, the valve 11 permits filling material to flow through a dispensing opening 12. As it does so, the filling material forms a jet 13 that enters a container 2. In its closed state, shown in FIG. 2, the valve 11 blocks the flow of filling material through the dispensing opening 12.

Referring to FIG. 3, the valve 11 includes a funnel-shaped diaphragm 14 made of a product-compatible elastic material. Examples of elastic material include elastomer plastics, and PTFE.

The diaphragm 14 interacts with a rod 15 that extends coaxially with the filling-element axis FA inside the liquid channel 8. An annular gap exists around the rod 15 so that filling material can flow past the rod 15.

Figure 4:
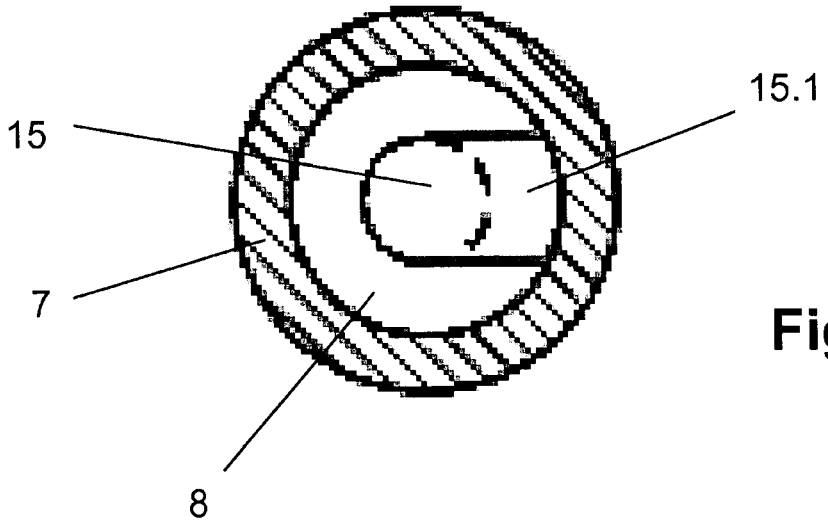
FIG. 4 is a transverse section at the line I-I from FIG. 1.

As shown in FIG. 4, a laterally-projecting extension piece 15.1 connects an upper end of the rod 15 to the housing 7 and holds it in the liquid channel 8. The rod 15 itself tapers at its upper and lower end, as shown in FIG. 3. The lower end has a conical taper that forms a valve surface 15.2. This valve surface 15.2 abuts the diaphragm 14 when the valve 11 closes.

A hollow piston 16 actuates the diaphragm 14. The piston 16 includes a body 17 shaped like a cap or a bowl. The piston's body 17 has a cylindrical section 17.1 that concentrically surrounds the housing 7 and merges into a base section 17.2. A hole in the base section 17.2 defines the dispensing opening 12. By means of the cylindrical section 17.1, the piston body 17 is displaceable along the filling element axis FA.

Referring to FIG. 3, the diaphragm 14 has an upper diaphragm-edge 14.1 and a lower diaphragm-edge 14.4 that define respective upper and lower diaphragm openings. An upper diaphragm-section 14.2 extends downward from the upper diaphragm-edge 14.1 and a lower diaphragm-section 14.3 extends upward from the lower diaphragm-edge 14.4.

The upper diaphragm-section 14.2 has a diameter that decreases with increasing distance from the upper opening edge. The lower diaphragm-section 14.3 has an essentially constant diameter along its length. In the illustrated embodiment, the upper diaphragm-section 14.2 extends a greater distance along the filling-element axis FA than does the lower diaphragm-section 14.3. However, this is not absolutely necessary.

The upper diaphragm-edge 14.1 engages the housing 7 so as to apply considerable tension to the diaphragm 14. The diaphragm 14 is oriented such that its axis is coaxial to the filling element axis FA. When the valve 11 opens, the diaphragm 14 forms a continuation of the liquid channel 8.

The lower diaphragm-section 14.3 continues through the opening in the piston's base section 17.2 where the lower diaphragm-edge 14.4 connects to the underside of the piston's base section 17.2 facing away from the filling element housing 7. When the valve 11 opens, the lower opening of the closure diaphragm 14 forms the dispensing opening 12.

An upper extension piece at the outer surface of the filling element housing 7 and an interior ring-shaped web of the piston's body 17 cooperate to form an upper control chamber 18 therebetween. Meanwhile, a lower collar and the interior ring-shaped web of the piston's body 17 cooperate to form a lower control chamber 19 therebetween. The upper and lower control chambers 18, 19 are thus offset relative to each other along the filling element axis FA between the outer surface of the filling element housing 7 and the inner surface of the piston's cylindrical section 17.1. Seals seal the upper and lower control chambers 18, 19 from each other and from the exterior environment.

The upper and lower control chambers 18, 19 can be filled in a controlled manner with a pressure medium, such as compressed air. This moves the hollow piston 16, and in particular, the piston's body 17, up and down in a controlled manner to open or close the valve 11.

When pressure medium flows into the upper control chamber 18, the piston's body 17 moves downwards along the filling element axis FA. This causes the closure diaphragm 14 to move away from the valve surface 15.2, thus opening the valve 11. Similarly, when pressure medium flows into the lower control chamber 19, the piston's body 17 moves upwards along the filling element axis FA. As a result, the inner surface of the upper diaphragm-section 14.2 of the closure diaphragm 14 presses against the valve surface 15.2 and undergoes elastic deformation as it does so.

A process-control arrangement, which is not shown, controls the flow of pressure medium into and out of the first and second control chambers 18, 19 in response to measurement signals from the flow meter 10.

Figure 5:
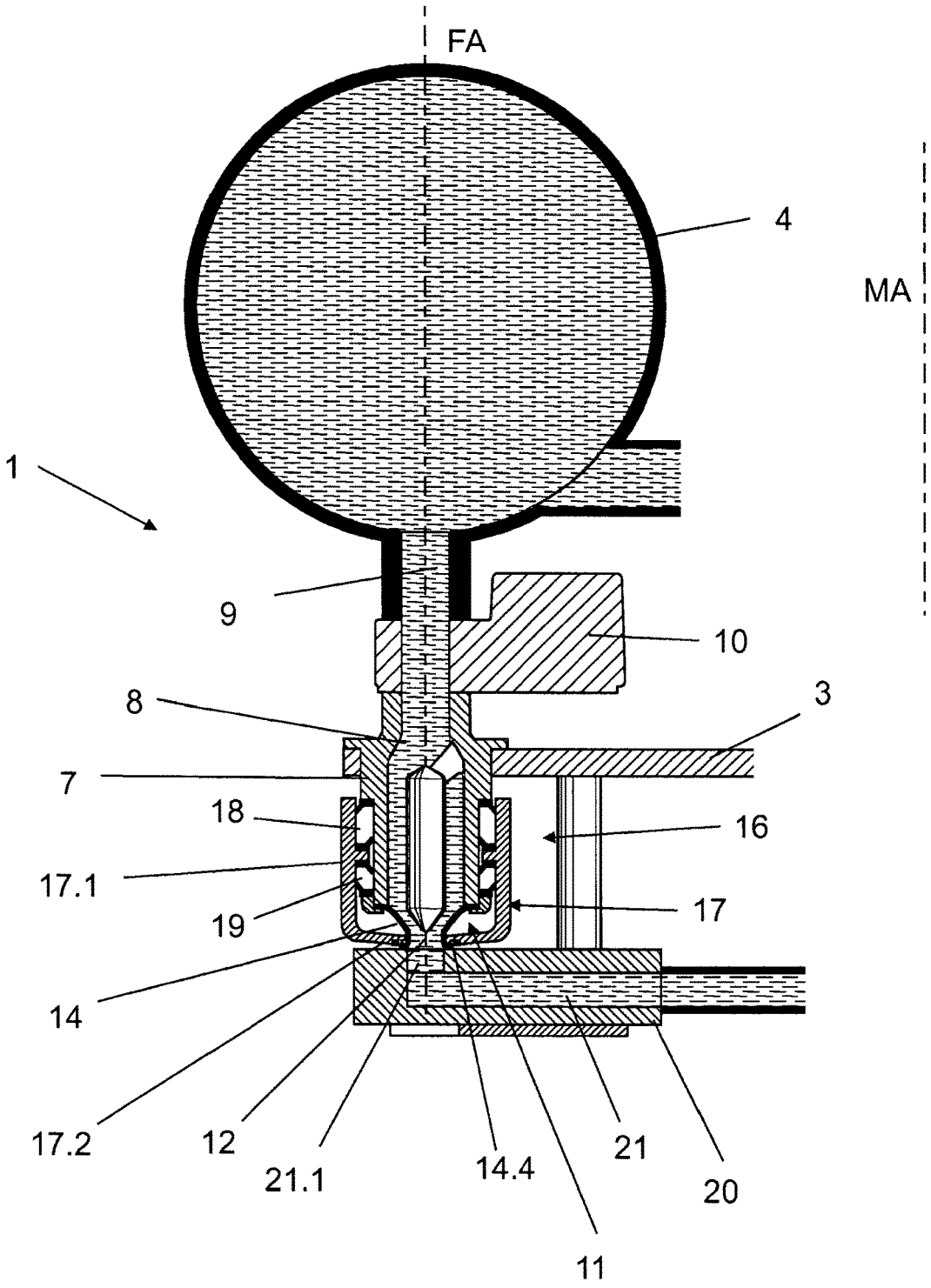
FIG. 5 shows the filling element of FIGS. 1-3 in CIP cleaning mode.

In CIP cleaning mode, shown in FIG. 5, a flushing plate 20 is arranged beneath each filling element 1 of the filling system. A flushing channel 21 within the flushing plate 20 ends in an opening 21.1 on an upper side of the flushing plate 20.

With the valve 11 open, the lower diaphragm-edge 14.4 of the closure membrane 14 abuts an edge of the opening 21.1, thus forming a seal. This forms an internal flow path for CIP cleaning medium that extends from the ring tank 4, through the filling element 1, and into the flushing channel 21.

Figure 6:
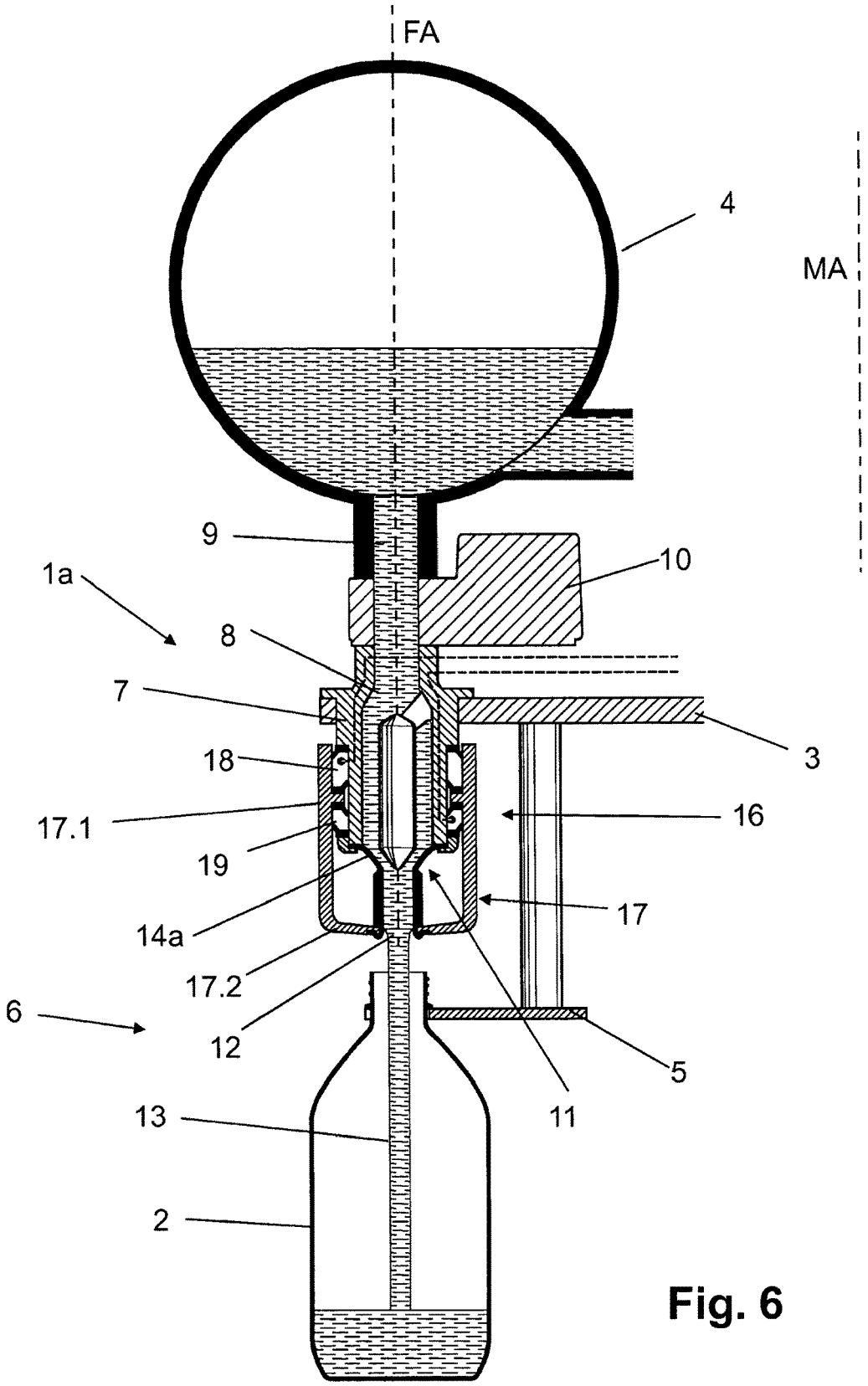
FIGS. 6-10 show views similar to those of FIGS. 1-5 for an alternative embodiment of a filling element.
Figure 7:
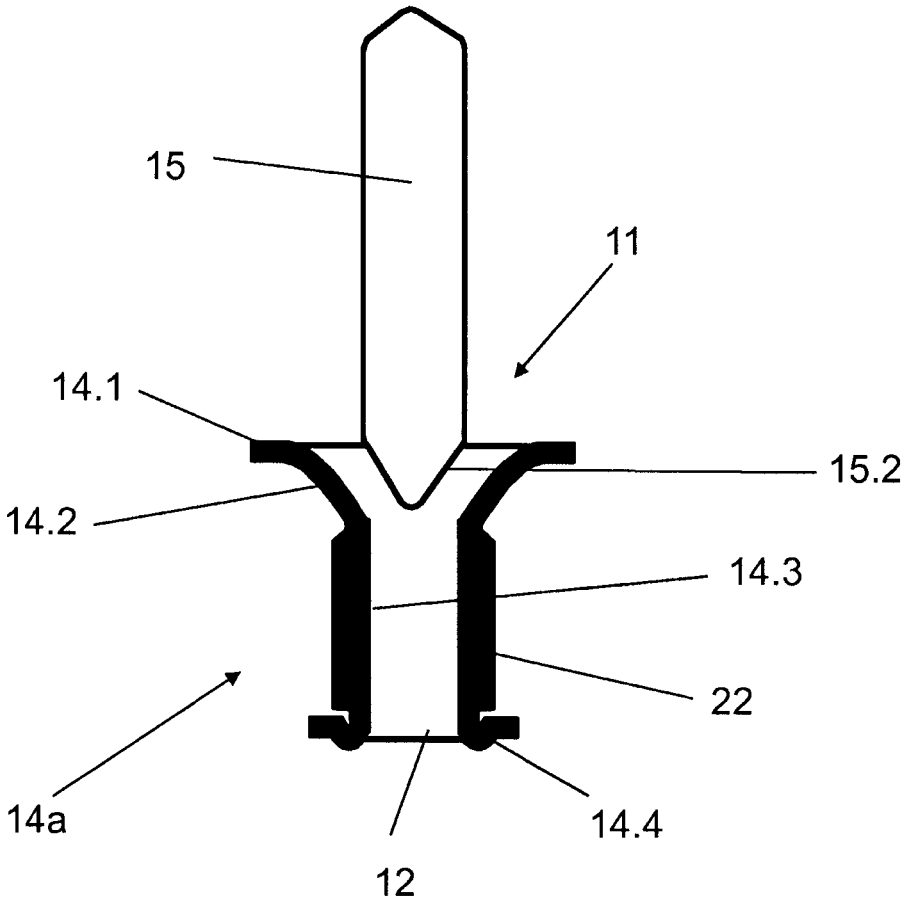

FIG. 6 shows a second embodiment of a filling element 1*a* in which the diaphragm 14*a* has a lower diaphragm-section 14.3 of greater axial length than the corresponding length of the lower diaphragm-section 14.3 of the closure diaphragm 14 shown in FIG. 3.

Because the lower-diaphragm section 14.3 is relatively long, it is useful to surround it with a rigid support tube 22. In some embodiments, the rigid support tube 22 is plastic. An upper side of the base section 17.2 supports the support tube 22.

When closing, the valve 11 deforms the upper diaphragm-section 14.2 of the closure diaphragm 14*a* in such a way that it butts against the valve surface 15.2 of the liquid channel, thus interrupting flow of filling-material. The lower diaphragm-section 14.3 of the closure diaphragm 14*a*, which the support tube 22 surrounds, forms and directs the jet 13.

Figure 8:
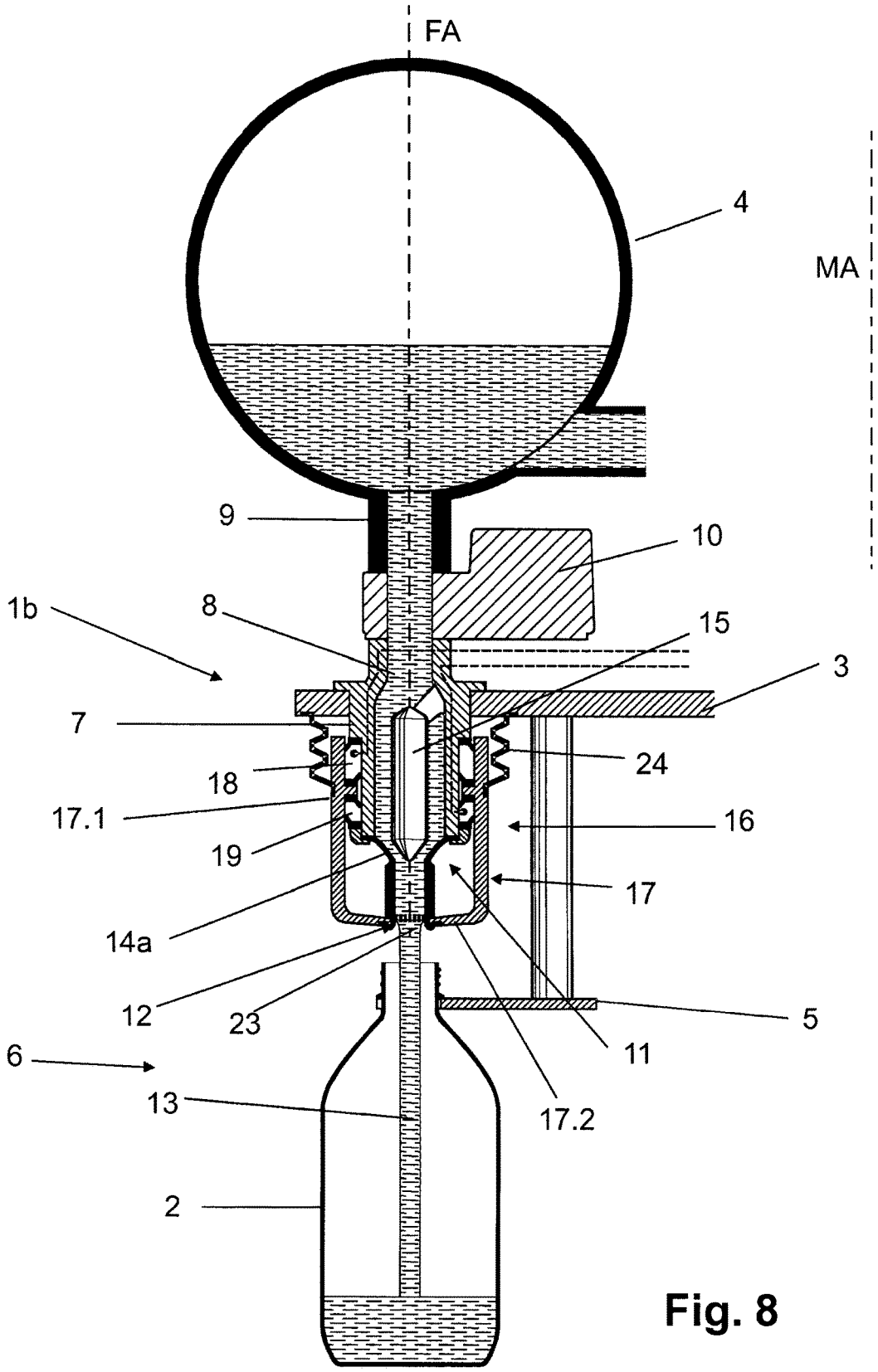

In a third embodiment, shown in FIG. 8, the filling element 1*b* has a gas block 23 at the dispensing opening 12. In some embodiments, the gas block 23 is a screen-type insert. The gas block 23 prevents filling material in the interior of the diaphragm 14*a* from dripping after the valve 11 closes.

The filling element 1*b* shown in FIG. 8 also has a bellows seal 24 between the rotor 3 and the cylindrical section 17.1. The bellows seal promotes hygiene by suppressing penetration of foreign substances into an intermediate space between the piston's body 17 and the outer surface of the filling element housing 7.

Figure 9:
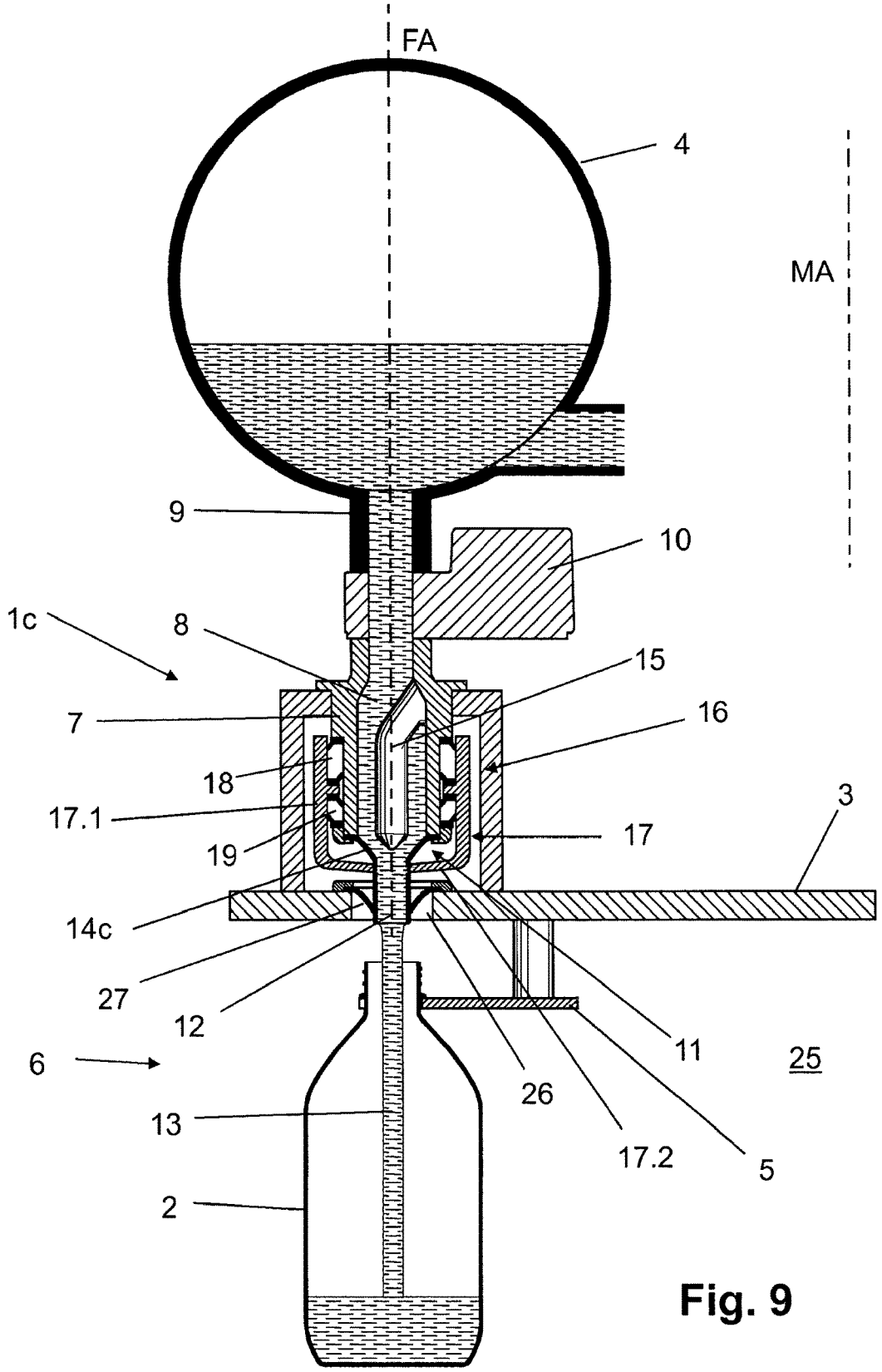

FIG. 9 shows an alternative filling element 1*c* that promotes aseptic filling of products into the containers 2 by having the containers be filled in a sterile chamber 25 beneath the rotor 3. Only the container carriers 5 are inside this sterile chamber 25. The rest of the filling element 1*c* is outside the sterile chamber 25.

In the embodiment shown in FIG. 9, the closure diaphragm 14*c* has neither a lower diaphragm-edge 14.4 nor a support tube 22. The lower diaphragm-section 14.3 of the closure diaphragm 14*c* is guided through an opening of the base section 17.2 and is held in this base section 17.2 in such a way that the lower diaphragm-section 14.3 projects over an underside of the base section 17.2.

With the valve 11 open, the lower diaphragm-section 14.3 extends with its lower end through an opening 26 in the rotor 3 into the sterile chamber 25. This forms the dispensing opening 12. As the valve 11 opens and closes, the lower diaphragm-section 14.3 of the diaphragm 14*c* moves axially along the filling element axis FA.

A seal 27 seals the opening 26 in the region surrounding the lower diaphragm-section 14.3. The seal 27 has a first side and a second side. The seal's first side attaches to one side to the rotor 3. The seal's second side attaches to the lower diaphragm-section 14.3. The seal 27 is elastic enough to follow the movement of the lower diaphragm-section 14.3 as the valve 11 opens and closes.

In the embodiment shown, the seal 27 is shaped like a cone or funnel having an upper edge that has a large cross-section and a progressively smaller cross-section towards the container 2. The seal's upper edge connects to the upper side of the rotor 3 and surrounds the opening 26. Its lower edge connects to the lower diaphragm-section 14.3 in the vicinity of the dispensing opening 12. In some embodiments, the seal 27 and the closure diaphragm 14*c* are integral and define a single piece.

In the embodiments described herein, a hollow piston 16 actuates the opening and closing of a valve 11. However, other actuating devices can be used to open and close a valve 11.

Figure 10:
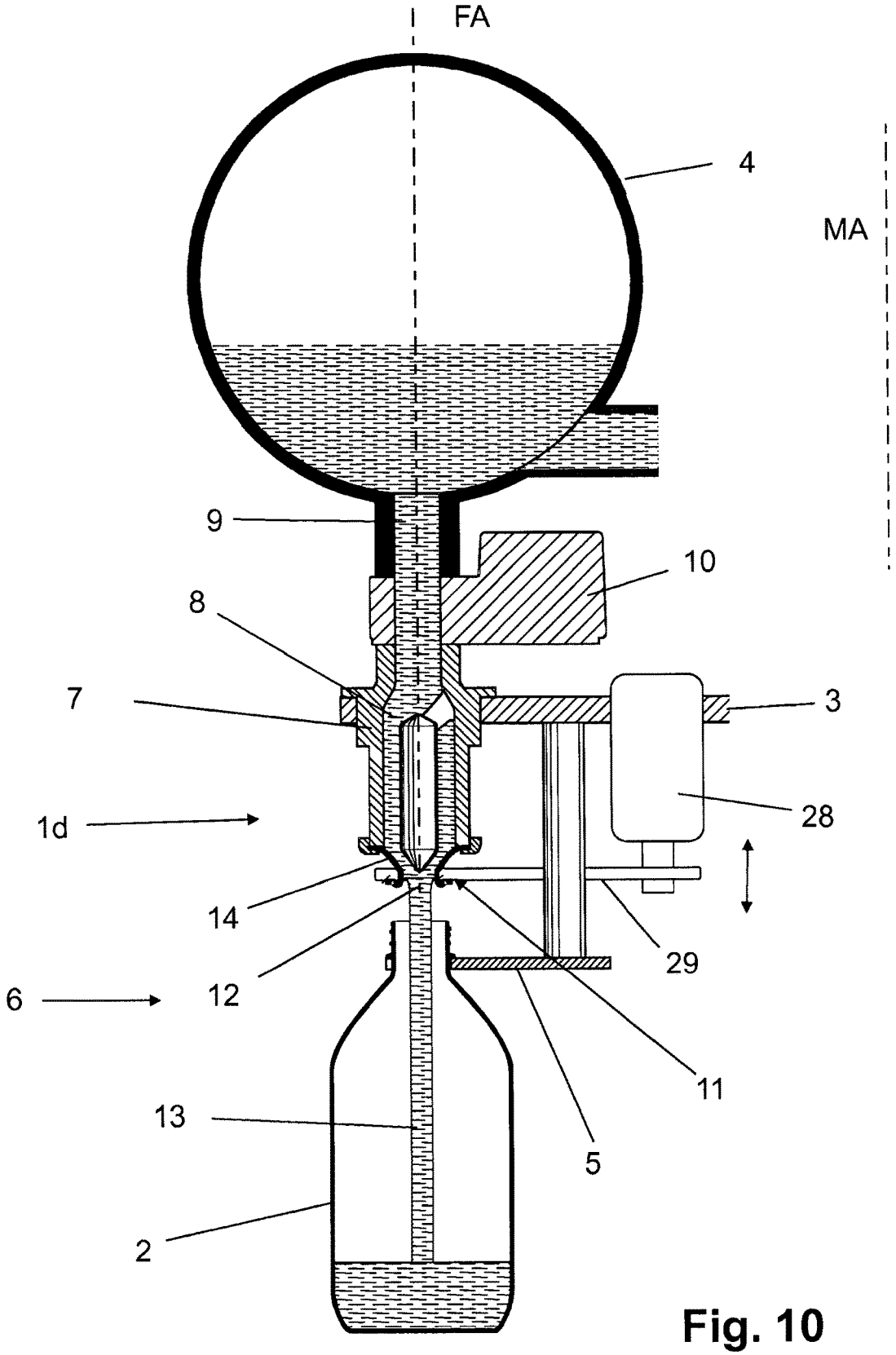

As an example, FIG. 10 shows a filling element 1*d* that replaces the hollow piston 16 with a pneumatic actuator 28 offset radially in relation to the filling element axis FA. The pneumatic actuator 28 couples to the valve 11 via a connecting element 29 on the funnel-shaped closure diaphragm 14 in the same way as has been described heretofore for the hollow piston 16.

All the embodiments described have it in common a rotationally-symmetric funnel-shaped elastic diaphragm 14, 14*a*, 14*b*, 14*c* that provides a simple way to open and close a valve 11 that, as a result of its elasticity, is able to adapt its state to correspond to the opened valve 11.

The filling elements 1, 1*a*-1*d* described herein thus have a much simpler valve that avoids having a conical valve body that needs to be moved by an actuating device. This reduces the number of components needed, reduces the mass that must be moved, and avoids having to have such parts as a valve cone and tappet. As a result, it reduces production costs. In addition, the use of an elastic diaphragm 14 results in a maintenance free or essentially maintenance free structure. Additional advantages relate to hygiene, and in particular to the avoidance of surfaces on which residues and contaminants may accumulate. This eases the burden of cleaning and/or disinfection of all the surfaces of the filling element 1 that come in contact with the filling-material, including the inner surfaces of the product line 9, the liquid channel 8, and the valve 11.

Moreover, with the optimum arrangement for the contents flow of the respective filling element 1 immediately below the contents tank 4, and with the formation of an exclusively vertical or essentially vertical flow path for the contents material in the measurement area of the flow meter 10, it becomes possible to avoid the movable and/or rigid elements that could impair the function of the flow meter 10.

The invention has been described heretofore on the basis of embodiments. It is understood that changes or deviations are possible without thereby leaving the scope and nature of the invention.

The invention claimed is:

1. An apparatus for filling containers with liquid filling material, said apparatus comprising a filling element, said filling element comprising a filling-element housing comprising a dispensing opening through which filling material flows into a container and a liquid channel formed in said housing through which filling material flows towards said dispensing opening, and a liquid valve arranged in said liquid channel and disposed to control flow through said liquid channel into said container through said dispensing opening, wherein said liquid valve comprises an elastic diaphragm made of elastic material and a rod having a tapered end, wherein said filling element further comprises an actuator that causes said diaphragm to transition between a first state, in which said diaphragm butts against said tapered end, and a second state, in which said diaphragm is spaced apart from said tapered end, wherein said diaphragm is a hollow structure that is rotationally symmetric in relation to a diaphragm axis thereof, wherein, when said liquid valve opens, said diaphragm forms a continuation of said liquid channel, wherein said diaphragm comprises a funnel-shaped first section that narrows in the direction of said dispensing opening, wherein said diaphragm abuts against said tapered end when said valve is closed, and wherein said abutment occurs as a result of pressure from said actuator.

2. The apparatus of claim 1, wherein said elastic material is an elastomeric plastic.

3. The apparatus of claim 1, wherein said elastic material comprises PTFE.

4. The apparatus of claim 1, wherein said diaphragm comprises a first section and a second section axially offset from said first section, wherein said first section has inner walls that define a cross-section that decreases towards said container, wherein said rod abuts said inner walls, and wherein said second section has a constant cross-section.

5. The apparatus of claim 1, wherein said diaphragm comprises a first opening and a second opening, wherein said first opening has a larger cross-section than said second opening, wherein said rod passes through said first opening when closing said valve, and wherein said second opening forms said dispensing opening.

6. The apparatus of claim 1, wherein said actuator connects to said diaphragm.

7. The apparatus of claim 1, wherein said diaphragm comprises an end region at said dispensing opening, and wherein said end region connects to said actuator.

8. The apparatus of claim 1, further comprising a support tube, wherein said diaphragm is a funnel-shaped diaphragm having a section surrounded by said support tube, wherein said section forms a jet director.

9. The apparatus of claim 1, wherein said actuator comprises a hollow piston, said hollow piston comprising a cylindrical body section configured to be axially displaceable along a filling element axis of said filling element, and a base section having an opening, wherein said base section engages said diaphragm.

10. The apparatus of claim 1, wherein said actuator is displaced radially in relation to a filling element axis of said filling element, wherein said actuator is coupled for actuation of said diaphragm.

11. The apparatus of claim 1, wherein said filling element is configured for free-jet filling of containers.

12. The apparatus of claim 1, further comprising a tank containing said filling-material, a plurality of flow meters, and a plurality of product lines, each of which connects a filling element to said tank, wherein each of said product lines has an axis parallel to a filling element axis, wherein each of said product lines includes one of said flow meters.

13. An apparatus for filling containers with liquid filling material, said apparatus comprising a filling element, said filling element comprising a filling-element housing comprising a dispensing opening through which filling material flows into a container and a liquid channel formed in said housing through which filling material flows towards said dispensing opening, and a liquid valve arranged in said liquid channel and disposed to control flow through said liquid channel into said container through said dispensing opening, wherein said liquid valve comprises an elastic diaphragm made of elastic material and a valve surface, wherein said filling element further comprises an actuator that causes said diaphragm to transition between a first state, in which said diaphragm butts against said valve surface, and a second state, in which said diaphragm is spaced apart from said valve surface, wherein said diaphragm is a hollow structure that is rotationally symmetric in relation to a diaphragm axis thereof, wherein said liquid valve further comprises a body having a surface that forms said valve surface, wherein said diaphragm abuts against said valve surface when said valve is closed, and wherein said abutment occurs as a result of pressure from said actuator, said apparatus further comprising a filling machine, said filling machine comprising a rotor that is drivable to rotate about a vertical machine axis, wherein said filling element is one of a plurality of identical filling elements disposed on said rotor, said apparatus further comprising container carriers, each of which is associated with one of said filling elements to form a filling position, said apparatus further comprising a sterile chamber beneath said rotor, wherein said filling elements are arranged outside said sterile chamber and above said rotor, wherein said sterile chamber comprises openings through which dispensing openings of said filling elements provide filling-material, wherein each of said filling elements comprises a seal, wherein said seal is secured to said diaphragm such that motion of said diaphragm causes motion of said seal, wherein said seal seals a portion of an opening through which said filling element provides filling-material, wherein said portion of said opening through which said filling element provides filling-material is a portion that is not occupied by said diaphragm of said filling element.

* * * * *